US012774564B2

(12) United States Patent
Sobhanadhas et al.

(10) Patent No.: US 12,774,564 B2
(45) Date of Patent: Oct. 27, 2026

(54) PROCESS FOR IMPROVING MOISTURE- AND WATER-RESISTANCE OF PAPER

(71) Applicant: METGEN OY, Kaarina (FI)

(72) Inventors: Liji Sobhana Seleenmary Sobhanadhas, Kaarina (FI); Petri Tapani Ihalainen, Kaarina (FI); Matti Wilhelm Heikkila, Kaarina (FI); Tanja Pauliina Saloranta, Kaarina (FI)

(73) Assignee: METGEN OY, Kaarina (FI)

( * ) Notice: Subject to any disclaimer, the term of this patent is extended or adjusted under 35 U.S.C. 154(b) by 410 days.

(21) Appl. No.: 18/279,411

(22) PCT Filed: Mar. 9, 2022

(86) PCT No.: PCT/EP2022/056002
§ 371 (c)(1),
(2) Date: Aug. 30, 2023

(87) PCT Pub. No.: WO2022/189488
PCT Pub. Date: Sep. 15, 2022

(65) Prior Publication Data

US 2024/0301629 A1 Sep. 12, 2024

(30) Foreign Application Priority Data

Mar. 11, 2021 (FI) ..... 20215260

(51) Int. Cl.
*D21H 21/16* (2006.01)
*D21H 17/15* (2006.01)
*D21H 17/23* (2006.01)

(52) U.S. Cl.
CPC ..... *D21H 21/16* (2013.01); *D21H 17/15* (2013.01); *D21H 17/23* (2013.01)

(58) Field of Classification Search
CPC ..... D21H 21/16; D21H 17/15; D21H 17/23
See application file for complete search history.

(56) References Cited

U.S. PATENT DOCUMENTS 6,359,040 B1 * 3/2002 Burdick ..... D21H 21/10 524/517
2017/0335520 A1 * 11/2017 Ehrhardt ..... D21H 17/24

FOREIGN PATENT DOCUMENTS

EP 3409727 A1 12/2018
EP 3561177 A1 10/2019
WO 2013050661 A1 4/2013
(Continued)

OTHER PUBLICATIONS

Hararak et al, Single-Solvent Fractionation and Electro-Spinning Neat Softwood Kraft Lignin, 2023, Applied Bio Materials (Year: 2023).*

(Continued)

*Primary Examiner* — Abbas Rashid
*Assistant Examiner* — Elisa H Vera
(74) *Attorney, Agent, or Firm* — Carter, DeLuca & Farrell LLP; Vadim Vapnyar

(57) ABSTRACT

The present disclosure relates to the field of papermaking, especially to the manufacture of paper with improved moisture- and water-resistance. The present disclosure also relates to a paper with improved moisture- and water-resistance obtained by the process as well as compositions useful in the process of making moisture- and water-resistant paper.

18 Claims, 15 Drawing Sheets

(56) References Cited

FOREIGN PATENT DOCUMENTS

| | | | |
|---|---|---|---|
| WO | 2014029919 | A1 | 2/2014 |
| WO | 2014116173 | A1 | 7/2014 |
| WO | 2018019707 | A1 | 2/2018 |
| WO | 2020178798 | A1 | 9/2020 |
| WO | 2021019468 | A1 | 2/2021 |
| WO | 2021209918 | A1 | 10/2021 |
| WO | 2022058656 | A1 | 3/2022 |

OTHER PUBLICATIONS

International Search Report and Written Opinion of the International Searching Authority issued in corresponding application PCT/EP2022/056002 mailed Jun. 21, 2022 (12 pages).
European Examination Report issued in corresponding application EP 22 713 619.9 mailed Dec. 18, 2025.

* cited by examiner

| | Furnish | Hardwood lignin | Softwood lignin |
|---|---|---|---|
| SCT Improvement (%) vs.vs. reference **Low moisture (50%)** | OCC | 35-42 | 55-84 |
| | NSSC | 12-17 | 29-55 |
| | UBSK+RCF | 12-16 | 46-50 |
| SCT Improvement (%) vs.vs. reference **High moisture (90%)** | OCC | 37-40 | 58-75 |
| | NSSC | 14-18 | 17-34 |
| | UBSK+RCF | 19-23 | 41-45 |

FIG. 1

10 kV
2000 pA
BSD $e^-$
400 x

| Furnish | Hardwood lignin | Softwood lignin |
|---|---|---|
| OCC | 34-61 | 29-68 |
| NSSC | 19-47 | 39-72 |
| UBSK+RCF | 26-30 | 44-48 |

FIG.7

PROCESS FOR IMPROVING MOISTURE- AND WATER-RESISTANCE OF PAPER

CROSS-REFERENCE TO RELATED APPLICATIONS

This application is a National Stage Application under 35 U.S.C. § 371 (a) of PCT/EP2022/056002, filed on Mar. 9, 2022, which claims the benefit of and priority to Finnish Patent Application No. 20215260 filed on Mar. 11, 2021. The entire contents of the foregoing applications are incorporated by reference herein.

TECHNICAL FIELD

The present disclosure relates to the field of papermaking, especially to the manufacture of paper with improved moisture- and water-resistance. The present disclosure also relates to a paper with improved moisture- and water-resistance obtainable by the present process as well as compositions for improving moisture- and water-resistance of paper.

BACKGROUND

Paper and board are versatile materials used for the packaging and distribution of a variety of commodities. Cellulose-based sheets used as package material include paper, board and the like, such as cardboard, corrugated board and corrugated cardboard. The most important feature of containers made from paper and board is to protect the packaged commodities against damage during storage and transport. Therefore, the maintenance of strength of the packaging material during storing, marketing and distribution of packed products is essential. Especially, this is important for food packages.

Paper and board are made of natural fibers of bleached or unbleached cellulose or are, alternatively, recycled from recovered materials. Chemical agents are needed in the manufacture of paper and boards to achieve different technical functionalities. They are either added to the pulp during production or coated onto the surface afterwards.

Alkenyl succinic anhydride (ASA) or alkyl ketene dimer (AKD) are commonly used sizing agents in the paper making industry as components in sizing dispersion formulations, used for achieving water resistance and hydrophobicity in a packaging material. These chemicals, however, are oil-based chemicals and cause problems as regards to repulpability and biodegradability. Furthermore, said chemicals often originate from different manufacturing plants, i.e. the chemicals are not combined together, which may cause problems.

The strength value is currently achieved by using high quality material having as long fibers as possible. For example, in when using many recycle-based materials that is not always possible. Also, starch is used for improving strength.

The use of packaging materials coated with oil-based chemicals is, however, not a sustainable form of packaging. Neither is the use of starch originating from food industry a sustainable choice.

Patent publication EP 3561177 A1 relates to the use of depolymerized lignin together with an aluminum salt in the papermaking process to increase the hydrophobicity of the resulting paper product.

Despite the advances, there remains a need of improved methods for preparing paper with improved properties.

SUMMARY

This description relates to a method for the manufacture of a paper sheet with an increased resistance to aqueous penetration. The term "resistance to aqueous penetration" is used herein to indicate the tendency of paper to resist the penetration of water or moisture (water in air) as reviewed by Hubbe (NCSU.edu/bioresources 2006; 2(1) 106-145). It is used in the art as a synonym for moisture resistance or water-resistance.

We surprisingly found that a paper with an increased resistance to aqueous penetration may be obtained by providing a lignin emulsion with a surface tension of 35-60 N/m comprising a mixture of a lignin dispersion in an aqueous medium at a concentration of at least 50 g/l of dry solid content and at least one carboxylic acid having a carbon chain length of at least 12 carbon atoms, wherein the lignin dispersion has an alkaline pH, and wherein the lignin is depleted of molecules with a molecular weight below 2 kDa, or more, adding said emulsion to a fibrous web during the semi-wet phase of a papermaking process, thereby obtaining a paper sheet with an increased resistance to aqueous penetration in comparison to a paper sheet manufactured by an otherwise identical process without the lignin emulsion.

We also surprisingly found that emulsions comprising high molecular weight lignin are much more stable than similar emulsions made from crude lignin. In more detail the emulsions prepared with crude lignin undergo lignin aggregation, phase separation and sharp increase in viscosity and loss of homogeneity usually within 2 days of preparation. Whereas the emulsions prepared according to the process as described herein are stable for more than 3 months, maintaining the same or almost the same structure and viscosity.

The term "at least one carboxylic acid" is used herein to indicate at least one species of a carboxylic acid. The lignin dispersion advantageously has an alkaline pH, preferably pH 9-11, and is depleted of lignin molecules with a molecular weight below 2 kDa, or more. Paper thus obtained has an increased resistance to aqueous penetration, which means that it absorbs liquids or vapors to a lesser degree than a paper sheet manufactured by an otherwise identical process without the lignin emulsion, and as a result better maintains strength in moist conditions. The term "additive" is synonymous with the term "emulsion" as used herein.

The concentration of lignin in the dispersion is largely determined by the fact that the dispersion should not be too diluted. Otherwise the application by spraying on the paper will be problematic since the amount of liquid should not be too high because a large amount of water would otherwise be required to deposit the desired amount of lignin emulsion. The upper limit of the concentration of lignin in the dispersion is determined by lignin solubility and by the dispersion stability. The range of suitable lignin concentration is determined by the surface tension suitable for the process of the invention.

It is well-known in the art that lignin dissolves readily in water at an alkaline pH (pH>7), even more readily at a pH of 9-11.

It was also surprisingly found that the lignin emulsion prepared as described above was remarkably stable. This was attributable to the fact that a lignin fraction was used wherein small molecules (with a molecular weight lower than 2 kDa) were removed from the lignin used to prepare the lignin dispersion.

The invention may also be described in other words, such that it relates to a process for the manufacture of paper with improved moisture- and water-resistance, characterized in that the process comprises the steps of:

i) preparing an additive by a) providing lignin in aqueous medium at a concentration of at least 50 g/l of dry solid content, and having pH of 5-13, preferably having pH of 10-11 to obtain a lignin dispersion;

b) optionally adding to the lignin dispersion, a carboxylic acid having a carbon chain length of at least 12 carbon atoms or any combination thereof to obtain a lignin emulsion of the lignin dispersion and the carboxylic acid;

c) optionally adjusting pH of the emulsion obtained in step b to pH 9-11, preferably to pH 9-10, to obtain a lignin emulsion;

d) obtaining an additive comprising the lignin dispersion or the lignin emulsion with surface tension of 35-60 N/m, preferably 45-60 N/m;

ii) adding said additive to a fibrous web during a semi-wet phase of a papermaking process; iii) obtaining a paper sheet with improved moisture- and water-resistance.

The disclosure also relates to a paper obtainable by the process, wherein the paper comprises lignin and has a compression index above 25 Nm/g, when incubated for 16 hours at 22° C. at 50% relative humidity or above 17 Nm/g when incubated for 16 hours at 22° C. at 90% relative humidity.

The disclosure also relates to a composition comprising lignin dispersion having a pH in a range of pH 5-13, such as 9-13 or 9-11 and having surface tension of 35-60 N/m, preferably of 45-60 N/m.

The disclosure also relates to a composition comprising an emulsion of a lignin dispersion and a carboxylic acid, wherein the carboxylic acid is a fatty acid, preferably a fatty selected from the group consisting of palmitic acid, stearic acid, gallates and abietic acid, and a mixture thereof, and wherein the emulsion has surface tension of 35-60 N/m, preferably of 45-60 N/m.

Further, the disclosure relates to a use of the claimed compositions as additives in papermaking process for improving the moisture- and water-resistance of paper obtained in said papermaking process.

BRIEF DESCRIPTION OF THE DRAWINGS

FIG. 1 depicts an impact of the lignin source on the strength improvement of OCC. Lignin originating from hardwood or softwood, can improve the quality of several furnishes used in packaging. The strength and humidity resistance of different furnishes can be improved by applying the additive according to the present process. Similar improvement in SCT can be achieved both at low moisture (50%) and at high moisture environment (90%). The abbreviations refer to: OCC, Old corrugated container pulp; NSSC, Neutral sulphite semi chemical pulp; UBSK, Unbleached softwood kraft pulp; RCF, Recovered Fiber pulp

FIG. 6A depicts a surface view of the sheet without the additive analyzed in conditions: 10 kV, 1000 pA, Sec $e^-$ 500× magnification. Empty space between the fibers can be seen.

FIG. 6B depicts a cross-sectional view of the sheet without the additive analyzed in conditions: 10 kV, 1000 pA, Sec $e^-$ 250× magnification. Empty space between the fibers can be seen.

FIG. 6C depicts a surface view of the sheet with the additive. 10 kV, 2000 pA, BSD $e^-$ 400× magnification. Spaces between fibers are filled with the additive.

FIG. 6D depicts a cross-sectional view of the sheet with the additive. 10 kV, 1200 pA, BSD $e^-$ 200× magnification. Spaces are filled all through the thickness of the sheet.

FIG. 7 depicts the impact on Cobb60 values (g/m$^2$) of lignins originating from different sources (hardwood and softwood) in the additive using different furnishes. The abbreviations refer to: OCC—Old corrugated container pulp; NSSC—Neutral sulphite semi chemical pulp; UBSK—Unbleached softwood kraft pulp; RCF—Recovered Fiber pulp.

DETAILED DESCRIPTION

It was surprisingly found that paper with improved moisture- and water-resistance can be produced using a process wherein lignin depleted of small lignin molecules in a specific concentration is added in the semi-wet phase of a papermaking process. Using a process of the present disclosure, a paper with an improved resistance to moisture and improved strength properties is obtained. Moisture- and water-resistance is measured using short span compression test (SCT) in high humidity conditions of 90% and Cobb60 test. Paper produced according to the process as described herein has higher moisture- and water-resistance than paper produced in a traditional internal sizing method by using AKD or SAE. The AKD or SAE is conventionally added as a dispersion to the wet fiber slurry. For enhanced retention a cationic component (usually a cationic starch) or a retention agent may be needed on a paper machine. The disadvantages related to the traditionally used sizing methods can be avoided by use of the present process and compositions instead of ASA and AKD, as well as starch. Furthermore, currently lignin is mainly burned, but using the process of the present disclosure, lignin can be utilized in bringing strength properties to the pulp fibers. When used in paper making according to the current disclosure, emulsions prepared with the disclosed method provide better moisture resistance as compared to the control samples prepared using crude lignin and samples prepared without an additive. This is demonstrated by the increased compression strength of the paper preconditioned in moist air (90% or 50% relative humidity). Paper samples prepared with the disclosed method also showed better strength in moist conditions than industry standard paper prepared using commercial sizing agent Styrene acrylate emulsion SAE. Results of Short-span compression test (SCT) of laboratory paper sheets prepared according to the disclosed method and control sheets are presented in the Example 4.

When used in paper making according to the current disclosure, emulsions prepared with the disclosed method provide better water resistance (also referred to as hydrophobicity), as compared to the control samples prepared using crude lignin and samples prepared without an additive. This is demonstrated by the decreased water absorption in Cobb 60 test. Paper samples prepared with the disclosed method also show better water resistance than industry standard paper prepared using sizing agent SAE. Results of Cobb60 test of laboratory paper sheets prepared according to the disclosed method and control sheets are presented in the Example 4.

Figure 3:
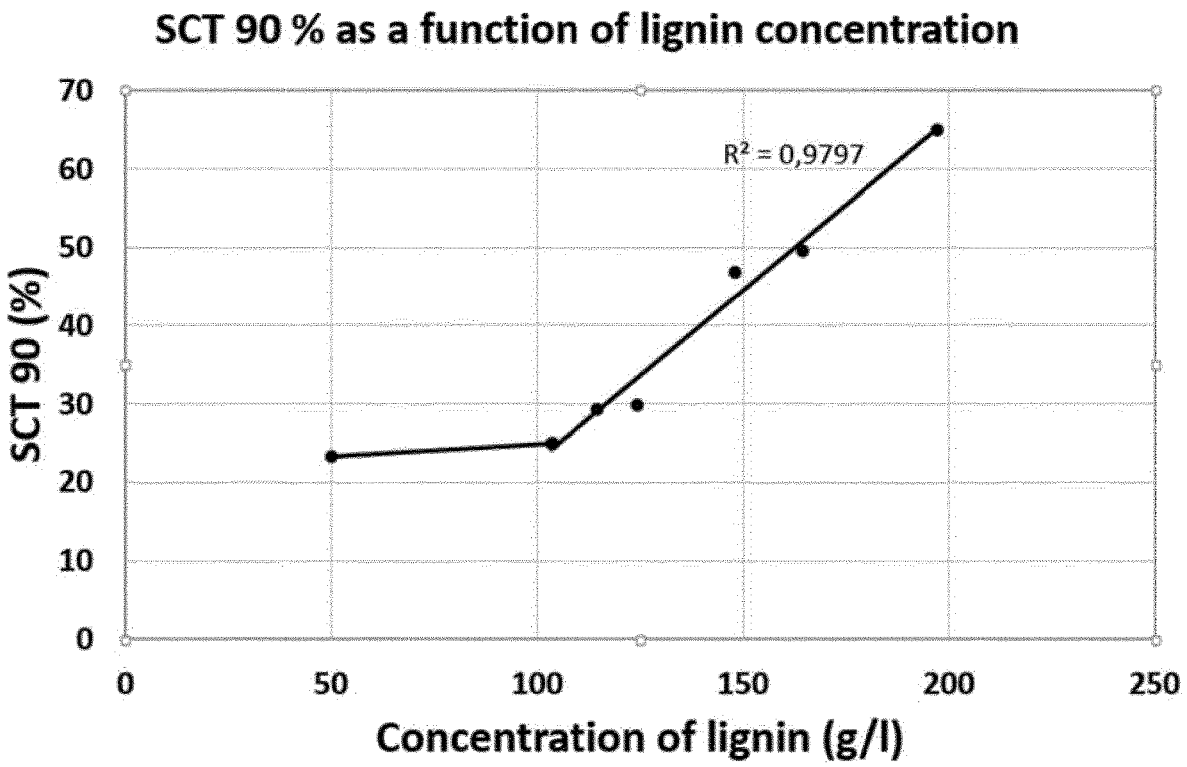
FIG. 3 depicts the percentage improvement of Short span compression test (SCT 90%) as a function of lignin concentration (g/i). Zero (0) represents a control sample without the lignin additive. Different lignin concentrations from 50 g/l to 200 g/l were used. It was observed that lignin concentration correlates with improvement of moisture- and water-resistance of OCC.
Figure 4:
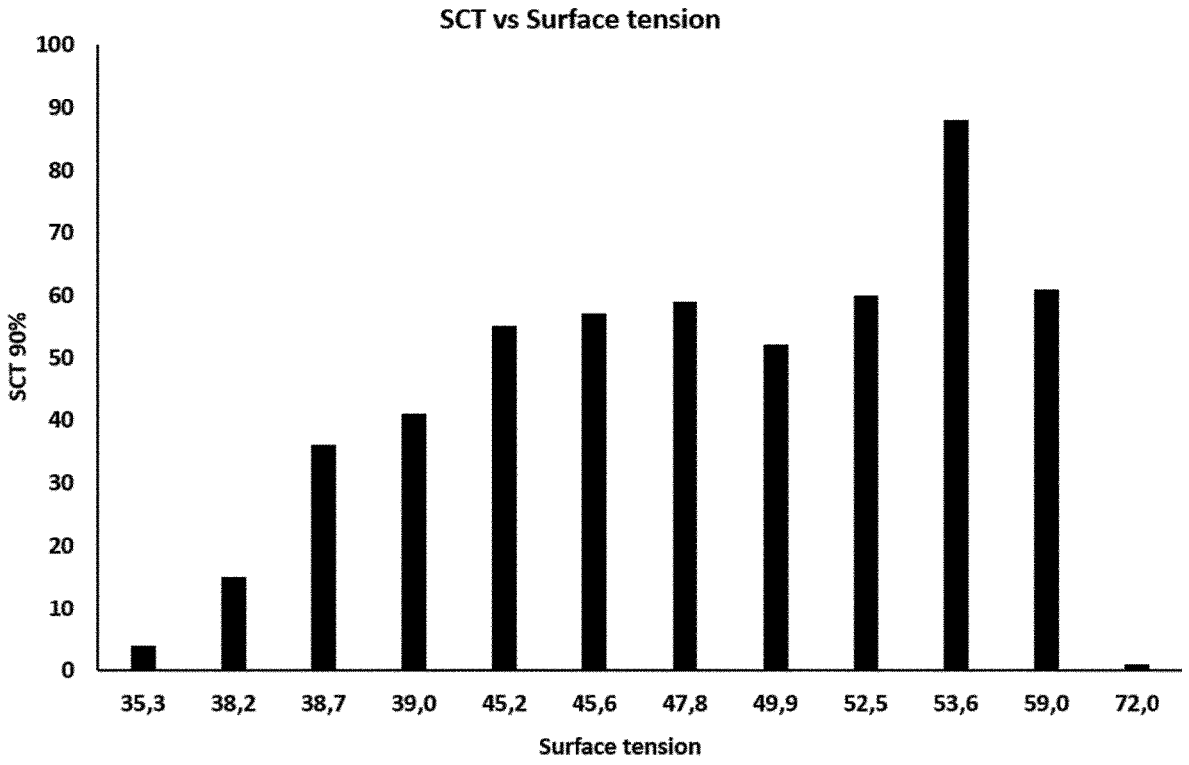
FIG. 4 depicts the percentage improvement of Short span compression test (SCT 90%) of paper as a function of surface tension (mN/m). Zero (0) represents a control sample without the lignin additive.

We also surprisingly found that stable dispersions and emulsions can be prepared with a much higher concentration of lignin (such as 200 g/L and even more), when HMW lignin is used, whereas rather crude lignin is usually dispersed to a concentration around 100 g/L or less and even such dispersions are stable only for a few days before lignin aggregation accrues. This is counterintuitive, as one would tend to assume that a more soluble low molecular weight lignin would be less prone to aggregation. Highly concentrated lignin emulsion is desirable for increasing moisture resistance, as seen from (FIG. 3)

We have also found that a lignin emulsion as described herein, which is based on HMW lignin provided better penetration of the emulsion to the pulp fibers and higher amount of the emulsion was retained by the fibers than the emulsion made from crude lignin or than the existing commercial additive-starch. This was confirmed by the scanning electron microscopy, which showed that the emulsion prepared according to the invention penetrates through the entire thickness of the paper sheet and fills the space between the pulp fibers as well as cavities inside the fibers (FIG. 6 A-D).

This high retention in the fiber space allowed for a high load of lignin to the fiber web without leaching of the lignin. Leaching of lignin to the waste water was detected by the UV absorption, lignin concentration in the waste water less than 1 g/L. On the contrary, the emulsion made from crude lignin resulted in the presence of lignin in the waste water (more than 10 g/L).

High lignin loading to the fiber web allowed for preparing paper of lighter weight and increased strength while using less fibers.

In an embodiment the emulsion was used in combination with starch.

We have also found that emulsion based on HMW lignin with the addition of starch provided better grease resistance to the paper as compared to the emulsion without starch. An industry standard grease resistance of KIT=5 could be obtained by adding 10% (v/v) of 18% starch solution to the emulsion according to the claim 1, whereas emulsion without starch provided only limited grease resistance of KIT3. These increased grease resistance was also confirmed by ISO 16532-1:2008 grease resistance test.

The addition of starch did not compromise paper strength, moisture resistance, or water resistance of the paper.

The technology of papermaking includes the methods, materials and equipment used to make paper, board and the like, such as cardboard and corrugated board and corrugated cardboard.

The terms "paper" and "board" are used interchangeably herein. In the art there is no clear distinction between paper and board. In the literature, the definition of the term paperboard varies. According to the ISO standardization body, a paper product with a grammage exceeding 200 g/m$^2$ is called paperboard. However, the definition by the Confederation of European Paper Industries (CEPI) reads "paper is usually called board when it is heavier than 220 g/m$^2$". The term "grammage" indicates the dry weight of a paper or fabric product, per unit of area expressed in grams per square meter (g/m$^2$). The term "dry weight" as used herein indicates the weight of all solid components of the paper sheet excluding water. In the art, the term "bone dry" is also used to indicate the dry weight of a material.

A "fiber" is a natural or synthetic structure that is significantly longer than it is wide. Fibers are often used in the manufacture of other materials. The use of cellulose fibers or lignocellulose fibers is well-known in the art of papermaking.

Paper is used widely for printing, writing, and packaging, among many other purposes and useful products. Today almost all paper is manufactured using industrial machinery. In a representative example of an industrial papermaking process, a dilute suspension consisting mostly of separate fibers such as cellulose fibers or lignocellulose fibers in a liquid carrier medium such as water is drained through a sieve-like screen, so that a web of randomly interwoven fibers is laid down forming a fibrous web also called a fibrous wet web. Liquid is then further removed from this fibrous wet web by pressing, sometimes aided by suction or vacuum. In a final step the paper is then dried, usually by heating. Once dry, a generally flat, uniform and strong sheet of paper is obtained.

In more detail, papermaking involves making a dilute suspension of fibers in liquid, such as water, called "furnish" or "slurry", and removing at least part of the water, for instance by forcing this suspension to drain through a screen, thereby creating a web of interwoven fibers. Water is removed from this web of fibers for instance by using a press. Fibers can be obtained by mechanical or chemical pulping and variations thereof.

The term "slurry" refers to a mixture of solids suspended in liquid, usually water.

The method of manual papermaking has changed very little over time, despite advances in technologies. The process of manufacturing handmade paper can be generalized into several distinctive steps: Separating the useful fiber from the rest of raw materials, (e.g. cellulose and lignocellulose from wood, cotton, etc.), processing the fiber into pulp, optionally adjusting the color, mechanical properties, chemical and biological properties and other properties of the paper by adding special chemical premixes, screening the resulting slurry, and pressing and drying to get the actual paper.

The term "screening" in this context is used as a process wherein fibers in water are drained through a sieve-like screen so that a mat or web of randomly interwoven fibers is obtained.

Screening the fiber may involve using a mesh made from non-corroding and inert material, such as brass, stainless steel or a synthetic fiber, which is stretched in a paper mold, a wooden frame similar to that of a window. The size of the paper is governed by the open area of the frame. The mold may then be completely submerged in the furnish, then pulled, shaken and drained, forming a uniform layer on the screen. Excess water is then removed, the wet web of fiber laid on top of a damp cloth or felt in a process called "couching". The process is repeated for the required number of sheets. Excess water from this stack of wet webs is then further removed, for instance by pressing in a hydraulic press. The fairly damp fiber may then be dried using a variety of methods, such as vacuum drying or simply air drying. Sometimes, the individual sheet is rolled to flatten, harden, and refine the surface. Finally, the paper is then cut to the desired shape or the standard shape (A4, letter, legal, etc.) and packed.

The term "pulp" refers to a composition comprising lignocellulosic fibrous material prepared by chemically or mechanically separating cellulose fibers from biomass, such as wood, fiber crops, fiber plants or wastepaper. The timber resources used to make wood pulp are referred to as pulpwood. Wood and other plant materials that may be used to make pulp contain three main components (apart from water): cellulose fibers (desired for papermaking), lignin (a three-dimensional polymer that binds the cellulose fibers together) and hemicelluloses, (shorter branched carbohydrate polymers). Wood pulp comes from softwood trees such as spruce, pine, fir, larch and hemlock, and hardwoods such as eucalyptus, aspen and birch.

Pulp is also referred to as a suspension that is characterized by its ability to absorb and retain water, which may be quantified as Canadian Standard Freeness (CSF) measured in milliliters. Defibrated wood material can be considered as pulp if its CSF can be determined.

Pulp can be manufactured using mechanical, semi-chemical or fully chemical methods (Kraft and sulfate processes). The finished product may be either bleached or non-bleached, depending on the end-application and customer requirements.

A pulp mill is a manufacturing facility that converts wood chips or fibers from other sources into a pulp of fibers that can be dried, baled and shipped to a paper mill for further processing. Alternatively, paper or board manufacturing facilities may be integrated, and never-dried pulp can be used directly for paper production.

The aim of the pulping process is to break down the native bulk structure of the fiber source, be it chips, stems or other plant parts, into the constituent fibers. Chemical pulping such as Kraft pulping achieves this by chemically degrading the lignin and hemicellulose into smaller, water-soluble molecules which can be washed away from the cellulose fibers without significantly depolymerizing the cellulose fibers. However, this chemical process depolymerizes the hemicellulose and weakens the physical strength of the fibers. Non-limiting examples of the pulp types include e.g. recovered fiber pulp/recycled cellulose fiber pulp (RCF), bleached Kraft pulp, unbleached Kraft pulp, unbleached softwood kraft pulp (UBSK), neutral sulfite semi chemical pulp (NSSC), thermo-mechanical pulp (TMP), wood pulp, hardwood pulp, softwood pulp, pulp obtained from old corrugated board, chemi-thermomechanical pulp (CTMP) and dissolving pulp and combinations thereof.

The Kraft process (also known as kraft pulping or sulfate process) is a process for conversion of wood into wood pulp, which consists of almost pure cellulose fibers. The Kraft process entails treatment of wood chips with a hot mixture of water, sodium hydroxide, and sodium sulfide, known as white liquor, which breaks the bonds that link lignin, hemicellulose, and cellulose. The technology entails several steps, both mechanical and chemical. It is the dominant method for producing chemical pulp.

The various mechanical pulping methods, such as groundwood (GW) and refiner mechanical pulping (RMP), physically tear the cellulose fibers one from another. Much of the lignin remains adhered to the fibers. Strength may also be impaired because the fibers may be cut.

There are a number of related hybrid pulping methods that use a combination of chemical and thermal treatment, for instance an abbreviated chemical pulping process, followed immediately by a mechanical treatment to separate the fibers. These hybrid methods include chemi-thermomechanical pulping, also known as CTMP. The chemical and thermal treatments reduce the amount of energy subsequently required by the mechanical treatment, and also reduce the loss of strength suffered by the fibers.

Mechanical pulping of wood is normally an energy intensive process; for example, a typical newsprint pulp may need 2160 kWh of refiner energy per ton of feedstock to refine wood chips into pulp.

Lignin is the second most abundant biopolymer on the earth and a major component of the plant cell wall. Lignin is also a major side-product for several industries, including the paper and pulping industry and the lignocellulosic biorefinery. Due to the recalcitrant nature of the complex polyphenolic structure, the utilization of lignin for the production of biofuels and bioproducts is a major challenge for both biorefineries and paper/pulping industry. As compared to cellulose and hemicellulose, the methods and systems for utilization of lignin are very limited.

The term "biorefinery lignin" as used herein refers to lignin that is derived from a complex biomass utilization process. Biorefinery lignin has to be distinguished from pulp and paper lignin. It differs in at least two properties, namely pulp and paper lignin is highly chemically oxidized lignin and therefore its average molecular weight is lower than the average molecular weight of biorefinery lignin. Moreover, biorefinery lignin has more active groups (such as reactive hydroxyls, aldehyde, carboxylic acid) in comparison to pulp and paper derived lignin. This is mainly because biorefinery lignin is usually generated by milder processes compared to pulp and paper lignin.

An industrial paper mill is divided into several sections, roughly corresponding to the processes involved in making handmade paper. Pulp is prepared, refined and mixed in liquid such as water with other additives to make a pulp slurry. The head-box of the paper machine (Fourdrinier machine) distributes the slurry onto a moving continuous screen, liquid drains from the slurry (for instance by gravity or under vacuum), the wet paper sheet or wet web goes through presses and dries, and finally rolls into large tambour rolls.

Another type of paper machine makes use of a cylinder mold that rotates while partially immersed in a container of dilute pulp. The pulp is picked up by the wire and covers the mold as it rises out of the vat (Clapperton, R. H. (1967) The Paper-Making Machine. It's Invention, Evolution, and Development, Pages 65-77). A couch roller is then usually pressed against the mold to smooth out the pulp and picks the wet web off the mold. The web is further dewatered by applying a pressure difference.

The present inventors studied the strength properties and hydrophobicity for packaging boxes when boxes are used in high humidity conditions especially in fruit packaging. For example, cardboard boxes for bananas must withstand high humidity and still remain strong enough.

The present inventors surprisingly found that paper with improved moisture- and water-resistance can be produced using a process wherein lignin in a specific concentration is added to the paper in the semi-wet phase of papermaking process. Using a process of the present disclosure, a paper with an improved moisture- and water-resistance is obtained. Paper produced according to the present process has higher water resistance than paper produced in a traditional internal sizing method by using AKD or SAE. The AKD or SAE is normally a dispersion added to the wet fiber slurry. For enhanced retention a cationic component (usually a cationic starch) or a retention agent may be needed on a paper machine.

The term "wet end" refers to a stage in the papermaking process wherein the fibers reside in the slurry.

As used herein the term "semi-wet phase" refers to a stage in the papermaking process which occurs after the wet end and before the dry end. "Semi-wet phase" refers to a stage wherein the fibrous web contains 20 to 90 mass % of water. In other words, the fibrous web in this phase contains 10 to 80 mass % of dry matter. Preferably a semi-wet phase refers to a stage wherein the fibrous web contains 20-30 mass % of water. "Semi-wet" or "semi-dry wet" or "semi-dry" means that the fibers are still in wet condition and not completely dried. The term "20 to 90 mass %" is to be understood as encompassing a range of percentages with a lower limit of 20, 25, 30, 35, 40, 50, 60, 70 or even 80% and an upper limit of 90, 85, 80, 75, 70, 65, 60, 55, 50, 40, or even 30%. This depends of the type of papermaking process that is applied. The semi-wet phase ends at a percentage of water content that the paper has when it enters the drying module. It can be defined that the wet phase starts when the fibers are dissolved in water, which may be at a water content of about 98-99%. For example, the water content of the slurry used to start the papermaking process may be in the order of 98 to almost 100% such as 98 to 99.99%, or between 98.5 and 99.8%. The slurry may also be more concentrated. This depends on the particular requirements of the process, requirements of which the skilled person is well aware.

Conversely, the term "dry end" refers to a stage in the papermaking process wherein the fibrous web contains less than 20 mass % of water, or 80 or more mass % of dry matter. Dry matter is defined herein as the relative weight of all components of a material excluding water. Dry weight of a material is the weight of all solid components excluding water. In the art, the term "bone dry" is also used to indicate the dry weight of a material.

In an embodiment the additive of the present disclosure is added to the fibrous web after the wet end and before the dry end.

The present inventors found that compressive strength of paper was remarkably increased and thus the moisture- and water-resistance of paper was improved by adding lignin dispersion or lignin emulsion as an additive during the semi-wet phase of the papermaking process.

Compressive strength or compression strength is the capacity of a material or structure to withstand physical deformation by compressive loads, as opposed to tensile strength, which withstands deformation loads tending to elongate the structure. In other words, compressive strength resists compression (being pushed together), whereas tensile strength resists tension (being pulled apart). In the study of strength of materials, tensile strength, compressive strength, and shear strength can be analyzed independently.

The present disclosure provides also a process for the manufacture of paper with improved moisture- and water-resistance, characterized in that the process comprises the steps of:

i) preparing an additive by a) providing lignin in aqueous medium at a concentration of at least 50 g/l of dry solid content, and having pH of 5-13, preferably having pH of 9-11, such as 10-11 to obtain a lignin dispersion;

b) optionally adding to the lignin dispersion, a carboxylic acid having a carbon chain length of at least 12 carbon atoms or any combination thereof to obtain a lignin emulsion of the lignin dispersion and the carboxylic acid;

c) optionally adjusting pH of the emulsion obtained in step b to pH 9-11, preferably to pH 9-10, to obtain a lignin emulsion;

d) obtaining an additive comprising the lignin dispersion or the lignin emulsion with surface tension of 35-60 N/m, preferably 45-60 N/m;

ii) adding said additive to a fibrous web during a semi-wet phase of a papermaking process; iii) obtaining a paper sheet with improved moisture- and water-resistance.

In an embodiment the pH of the lignin emulsion is adjusted to pH 9-11, preferably to pH 9-10.

If lignin is provided in a liquid form, no solubilization is needed. In case dry or semi-dry lignin is used, solubilization is advantageous. Possible solids present in the lignin are removed in a solid removal step, preferably using filtration, such as ultrafiltration.

The concentration of lignin in aqueous medium is at least 50 g/l of dry solid content, such as at least 55 g/l, at least 60 g/l, at least 65 g/l, at least 70 g/l, at least 75 g/l, at least 80 g/l, at least 85 g/l, at least 90 g/or at least 95 g/l.

Preferably the concentration of lignin in aqueous medium is at least 100/l of dry solid content, such as at least 110 g/l, at least 120 g/l, at least 130 g/l, or at least 140 g/l of dry solid content.

In an embodiment the concentration of the lignin in dispersion is at least 150 g/l, such as at least 160 g/l, at least 170 g/l, at least 180 g/l, at least 190 g/l, or at least 200 g/l of dry solid content, preferably at least 200 g/l of dry solid content.

In an embodiment the concentration of the lignin in aqueous medium is between 50 g/l and 200 g/l, such as 50 g/l-100 g/l, 50 g/l-150 g/l, 100 g/l-150 g/l, 70 g/l-100 g/l, 70 g/l-150 g/l, or 100 g/l-200 g/l.

Preferably small lignin fractions i.e. smallest molecular weight particles are removed, while bigger fractions remain. The presence of small lignin particles may result to problems, such as leaching.

In an embodiment of the process one or more carboxylic acids having a carbon chain length of at least 12 carbon atoms (C12) is added to the lignin dispersion to obtain an emulsion of the lignin dispersion and the carboxylic acid. Preferably the carboxylic acid is a fatty acid, preferably the fatty acid selected from the group consisting of palmitic acid, stearic acid, gallates and abietic acid, and a mixture thereof. The length of the carbon chains of the fatty acids may be chosen such that the surface tension of the emulsion does not fall out of the range of 35-60 N/m. The function of the fatty acid is among others to infer hydrophobicity to the paper, which increases water- and moisture-resistance, especially water resistance. The amount of the carboxylic acid to be added to the lignin dispersion may be determined experimentally to achieve the desired hydrophobicity of the paper. The amount of the carboxylic acid should be such that the surface tension of the emulsion does not fall out of the range of 35-60 N/m. This amount may, in a non-limiting example be between 5 and 20% such as 7-15% of the mass of lignin in the emulsion, preferably 10% of the mass of lignin.

The amount of carboxylic acid to be used is not critical. The lower level of the carboxylic acid is determined by the fact that an emulsion is to be obtained from the lignin dispersion. The upper limit is determined by the fact that a certain hydrophobicity is to be obtained. This can easily be determined by the skilled person, using a limited amount of trial and error.

In an embodiment the carboxylic acid has a carbon chain length of at least 12, 13, 14, 15, 16, 17, 18, 19, or 20 carbon atoms.

In an embodiment of the process pH of the emulsion of the lignin dispersion and the carboxylic acid is adjusted to pH 9-11, preferably to pH 9-10, to obtain a lignin emulsion.

Preferably the emulsion of the lignin dispersion and the carboxylic acid is an oil-in-water emulsion. The oil-in-water (O/W) emulsion may have the following properties: pH 8-11, more specifically 9-10; viscosity of 30-200 Cps, more specifically 100-150 Cps; concentration of 10-50%, more specifically 15-25%, zeta potential of −10 to −70 mV, more specifically −20 to −40 mV.

In an embodiment the emulsion of the lignin dispersion and the carboxylic acid is prepared by applying energy in the form of heat at a temperature between 40 and 200° C. and/or in the form of mechanical force, such as dispergating with a shear mixing. The temperature range may be in a range of 50-100° C., 70-100° C., 70-150° C., 90-150° C., 100-200° C., or 150-200° C. The temperature may be such as 40° C., 60° C., 80° C., 100° C., 120° C., 140° C., 160° C., 180° C. or 200° C.

In the present process lignin may be any lignin and prepared using any method. Lignin may originate from any origin, such as from hardwood, softwood or non-woody source or a combination thereof.

The lignin fraction may be for example a molecular weight (MW) fraction of 1-50 kDa, such as 2-50, 1-4 kDa, 4-8 kDa, 8-10 kDa, or 1-10 kDa.

As used herein, the term "high molecular weight lignin" indicates lignin with a molecular weight above 1 kDa, such as above 2 kDa, 4 kDa, 8 kDa, 20 kDa, or even 50 kDa. The high molecular weight lignin may have a molecular weight below 100 kDa, such as below 80 kDa, 70 kDa or 60 kDa.

The term "low molecular weight lignin" refers to a lignin with a molecular weight below 1 kDa, such as below 900 Da, 800 Da, 700 Da, 600 Da, 500 Da, 400 Da, 300 Da, or even 200 Da.

In a preferred embodiment a lignin fraction with a particular molecular weight range, i.e. molecular weight (MW) fraction of 1-50 kDa, more specifically 1-10 kDa, or 2-50 kDa or 2-10 kDa is used.

In other words, in a preferred embodiment lignin is depleted of lignin with a molecular weight below 1 kDa, preferably below 2 kDa, 4 kDa, 5 kDa, such as 10 kDa, 20 kDa, or 50 kDa.

The term "depleted" is used herein to indicate that molecules below a certain molecular weight are diminished in number or quantity. This can be achieved by selectively removing molecules below a certain molecular weight. This may be achieved by ultrafiltration with a filter with a molecular cut-off of 1 or 2 kDa, such as a molecular cut-off of 1500, 900 Da, 800 Da, 700 Da, 600 Da, 500 Da, 400 Da, 300 Da, or even smaller than 200 Da. Alternatively, ultrafiltration may be carried out with a filter with a cut-off value larger than 3 kDa, such as 4 kDa, 5 kDa, 6 kDa, 7 kDa, 8 kDa, 9 kDa, or 10 kDa, such as larger than 20 kDa, 30 kDa, 40 kDa, 50 kDa, 60 kDa, or 70 kDa or larger, as long as the desired molecular weight fraction, such as the low molecular weight fraction of lignin is selectively removed.

The phrase "selectively removed" is used herein to indicate that the fraction of lignin molecules with a low molecular weight is removed from the reaction mixture to a larger extent than at least some of the lignin molecules with a higher molecular weight. The skilled person is familiar with techniques how this may be achieved, such as for example by ultrafiltration in a fed-batch reactor or a continuous flow reactor.

A wide range of different molecular weight fractions of lignin species can be used. The invention works well over a broad range of lignin fractions and sources. The skilled person is well capable of performing ranges in order to determine the optimal effect for a given experimental set-up.

In a preferred embodiment, a paper is obtained that has an increased resistance to water penetration. This resistance to water penetration is increased and thus improved by adding an additive comprising a lignin fraction of 1 to 50 kDa or 2-50 kDa during the semi-wet phase of the papermaking process. Preferably said additive comprises a lignin dispersion or a lignin emulsion according to the present disclosure.

Advantageously, the additive is added to the fibrous web during a semi-wet phase of a papermaking process, in other words after the wet end and before the dry end of a papermaking process.

In an embodiment paper sheets are prepared by spraying an additive in the semi-wet phase, which is after the wet end and before the dry end of the papermaking process.

The fibrous web is formed from the fibrous slurry comprising fibers in water by selectively removing the water. The step of selectively removing the liquid may be performed by spreading the fibrous slurry over a wire and draining the liquid. The step of selectively removing the liquid may be performed using gravitational force, centrifugal force, compressing or blotting.

In an embodiment the fibers are obtained from pulp. Fibers can be obtained by chemical or mechanical pulping, or variations thereof. Non-limiting examples of suitable pulp types may be selected from the group consisting of recycled fibers pulp (RCF), bleached or unbleached Kraft pulp, neutral sulfite semi chemical pulp (NSSC), thermo-mechanical pulp (TMP), wood pulp, hardwood pulp, softwood pulp, pulp obtained from old corrugated board, chemi-thermomechanical pulp (CTMP) and dissolving pulp and combinations thereof.

In a preferred embodiment the fibers are selected from the group consisting of lignocellulose, hemicellulose and cellulose.

In a preferred embodiment of the process lignin is chemically modified such as with hydroxyalkylation, methylolation, esterification, etherification, demethylation, and/or allylation.

In a further preferred embodiment of the process a further composition selected from the group consisting of synthetic rubber latex, natural rubber latex, biodegradable polymers like polylactic acid (PLA) latex, and bio-based additive like starch is added to the lignin dispersion or lignin emulsion.

In an embodiment of the process lignin is size separated.

The disclosure also relates to a paper obtainable by the process as described herein, characterized in that the paper comprises lignin and has a compression index above 25 Nm/g, when incubated for 16 hours at 22° C. at 50% relative humidity or above 17 Nm/g when incubated for 16 hours at 22° C. at 90% relative humidity.

In a preferred embodiment the paper obtainable by the process comprises lignin dispersion or lignin emulsion.

The disclosure also relates to a composition comprising lignin in dispersion having pH in a range of pH 5-13, and having surface tension of 35-60 N/m, preferably of 50-60 N/m. Preferably the pH of said composition is on the pH range of pH 5-13, such as on the pH range of pH 6-12, pH 7-11, pH 8-11, or pH 9-11, preferably the pH is on the range of pH 10-11.

The disclosure also relates to a composition comprising an emulsion of a lignin dispersion and a carboxylic acid, characterized in that the carboxylic acid is a fatty acid, preferably a fatty selected from the group consisting of palmitic acid, stearic acid, gallates and abietic acid, and a mixture thereof, and wherein the emulsion has surface tension of 35-60 N/m, preferably of 45-60 N/m.

In an embodiment the pH of the lignin emulsion is pH 9-11, preferably pH 9-10.

In a further embodiment the disclosure relates to a lignin dispersion comprising a further compound selected from the group consisting of synthetic rubber latex, natural rubber latex, biodegradable polymers like polylactic acid (PLA) latex, and bio-based additive like starch.

In a further embodiment the disclosure relates to a lignin emulsion comprising a further compound selected from the group consisting of synthetic rubber latex, natural rubber latex, biodegradable polymers like polylactic acid (PLA) latex, and bio-based additive like starch.

The disclosure also relates to the use of a composition as described above as an additive in a papermaking process for improving the moisture- and water-resistance of paper obtained in said papermaking process.

In a preferred embodiment the additive is added to paper sheets by spraying or wet pressing.

In another preferred embodiment the additive is added to paper sheets by wet pressing. In a more preferred embodiment, the additive is added in the semi-wet phase of a papermaking process. In another more preferred embodiment, the additive is added after a press section of a papermaking process.

In a specific example a paper sheet is made from pulp suspension. The sheet is pressed mechanically to remove the excess water to reach about 40% dry sheet. The additive including lignin is applied onto the sheet by spraying. The obtained sheet is fully dried in a drier, such as Rapid Köthen drier. The sheet is cured in an oven. The cured sheet is conditioned for overnight in 50% or 90%. The strength and moisture- and water-resistance are measured.

In an embodiment of the present process a pulp suspension is provided, and a sheet is formed. Different furnishes are applicable. The sheet is pressed to 20-90% dryness, preferably to around 40% dryness. An additive containing lignin dispersion or lignin emulsion is applied as a uniform layer onto a sheet. Lignin from various sources and lignin fractions obtained using different treatment may be used. Application of the additive may be done using any conventional method, such as spraying or pressing. The obtained sheet is dried in a drier, such as Rapid Köthen drier at 70-90° C., preferably at 90° C. The dried sheet is cured in an oven at 60-120° C., preferably at 105° C. The cured sheet is conditioned for 4-24 hours, preferably overnight in 10-90%, preferably in 50% or 90%.

When the lignin is added on the fiber network according to the present process a remarkable increase in the short span compression test (SCT) is observed, as well as improved resistance to water penetration, preferably values below 50 $g/m^2$ with Cobb60 test, which is the expected value in the packaging boxes. In other words, water retention i.e. prevention of water penetration into matrix is improved.

Different sources of lignin and different processes at different pH conditions, different furnishes, different grammages of the sheet and different deposit grammages of the present composition may be used.

There are several ways of applying the composition to the paper, as well as several addition points available. The composition can be added at the wet end of the machine, or at the dry end of the machine. The composition can be applied by spraying on the top of sheet but also through the size press device to the material. Similar type of improvement is noticed using any of the ways of application or point of application. The present process is not limited to a specific method of application. Any method known in the art can be used to apply the composition.

In an embodiment, the inventors studied so called semi-wet application of the lignin fraction. The process is started with a pulp suspension. A sheet was formed, and it was pressed mechanically to remove the excess water to reach about 20-70% dry sheet, more specifically 30-40%. The coating was sprayed onto the sheet. Then the sheet is fully dried so that it is usable. After that curing is carried out in the oven which is somewhat mimicking what happens at the end of the paper machine when the roll is formed, and the paper is still warm and keeps warm for a while. Normal testing was done in the paper lab, including measuring the strength and moisture- and water-resistance.

The present process is not dependent on the lignin source. The difference between lignin sources may depend on several factors, such as viscosity, MW, pH, amount of charge groups, and concentration of lignin. The invention is that lignin from any origin brings the improvement in strength properties. However, the percentage of improvement depends on the lignin source. The use of softwood lignin may result in higher SCT than use of hardwood lignin. This is due to higher number of OH groups in the softwood compared to hardwood.

It is apparent to a person skilled in the art that as technology advanced, the basic idea of the invention can be implemented in various ways. The invention and its embodiments are therefore not restricted to the above examples, but they may vary within the scope of the claims.

As shown in the examples, the present inventors were able to successfully produce a moisture- and water-resistant paper with desired Cobb60 and strength values. Lignin dispersion or lignin emulsion was added during the semi-wet phase of a papermaking process i.e. after the process of making the fiber web by spraying it onto the semi-wet fiber web. The SCT and Cobb values of the resulting papers were then determined. It was observed that the hydrophobicity and SCT values were increased by the addition of lignin. This effect could be observed for paper exposed to air of 50% relative humidity as well as for paper exposed to air of 90% relative humidity.

In different terms, the invention can also be described in the following clauses:

1. A process for the manufacture of paper with improved moisture resistance, characterized in that the process comprises the steps of:

i) preparing an additive by a) providing lignin in aqueous medium at a concentration of at least 50 g/l of dry solid content, and having pH of 5-13, preferably having pH of 10-11 to obtain a lignin dispersion;

b) optionally adding to the lignin dispersion, a carboxylic acid having a carbon chain length of at least 12 carbon atoms or any combination thereof to obtain a lignin emulsion of the lignin dispersion and the carboxylic acid;

c) optionally adjusting pH of the emulsion obtained in step b to pH 9-11, preferably to pH 9-10, to obtain a lignin emulsion;

d) obtaining an additive comprising the lignin dispersion or the lignin emulsion with surface tension of 35-60 N/m, preferably of 45-60 N/m;

ii) adding said additive to a fibrous web during a semi-wet phase of a papermaking process;

iii) obtaining a paper sheet with improved moisture resistance.

2. The process according to claim 1, characterized in that the concentration of the lignin in aqueous medium is preferably at least 100 g/l of dry solid content, more preferably at least 150 g/l of dry solid content.

3. The process according to claim 1 or 2, characterized in that the carboxylic acid is a fatty acid, preferably a fatty acid selected from the group consisting of palmitic acid, stearic acid, gallates and abietic acid, and a mixture thereof.

4. The process according to any one of the preceding claims, characterized in that the emulsion of the lignin dispersion and the carboxylic acid is an oil-in-water emulsion.

5. The process according to any one of the preceding claims, characterized in that the emulsion of the lignin dispersion and the carboxylic acid is prepared by applying energy in the form of heat at a temperature between 40 and 200° C. and/or in the form of mechanical force, such as dispergating with a shear mixer.

6. The process according to any one of the preceding claims, characterized in that the lignin originates from hardwood, softwood or non-woody source or a combination thereof.

7. The process according to any one of the preceding claims, characterized in that additive is added to the fibrous web after the wet end and before the dry end of a papermaking process.

8. The process according to any one of the preceding claims, characterized in that the fibrous web is formed from the fibrous slurry comprising fibers in water by selectively removing the water.

9. The process according to claim 8, characterized in that the fibers are obtained from a pulp selected from the group consisting of recycled fibers pulp (RCF), bleached or unbleached Kraft pulp, neutral sulfite semi chemical pulp (NSSC), thermo-mechanical pulp (TMP), wood pulp, hardwood pulp, softwood pulp, pulp obtained from old corrugated board, chemi-thermomechanical pulp (CTMP) and dissolving pulp and combinations thereof.

10. The process according to claim 8 or 9, characterized in that the fibers are selected from the group consisting of lignocellulose, hemicellulose and cellulose.

11. The process according to any one of the preceding claims, characterized in that the lignin is chemically modified such as with hydroxyalkylation, methylolation, esterification, etherification, demethylation, and/or allylation.

12. The process according to any one of the preceding claims, characterized in that a further compound selected from the group consisting of synthetic rubber latex, natural rubber latex, biodegradable polymers like polylactic acid (PLA) latex, and bio-based additive like starch is added to the lignin dispersion or lignin emulsion.

13. The process according to any one of the preceding claims, characterized in that the lignin is size separated.

14. The process according to any one of the preceding claims, characterized in that lignin is depleted of lignin with a molecular weight below 1 kDa, preferably below 2 kDa, 3 kDa, 4 kDa, 8 kDa or 10 kDa.

15. Paper obtainable by the process according to any one of the preceding claims, characterized in that the paper comprises lignin and has a compression index above 25 Nm/g, when incubated for 16 hours at 22° C. at 50% relative humidity or above 17 Nm/g when incubated for 16 hours at 22° C. at 90% relative humidity.

16. A composition comprising lignin dispersion, characterized in that the lignin dispersion has pH in a range of pH 5-13 and has surface tension of 35-60 N/m, preferably of 45-60 N/m.

17. A composition comprising an emulsion of a lignin dispersion and a carboxylic acid, characterized in that the carboxylic acid is a fatty acid, preferably a fatty selected from the group consisting of palmitic acid, stearic acid, gallates and abietic acid, and a mixture thereof, and wherein the emulsion has surface tension of 35-60 N/m, preferably of 45-60 N/m.

18. A use of a composition according to claim 16 or 17 as an additive in a papermaking process for improving the moisture resistance of paper obtained in said papermaking process.

19. The use according to claim 18, characterized in that the additive is added by spraying or wet pressing.

20. The use according to claim 18, characterized in that the additive is added in a semi-wet phase of the papermaking process, or after a press section of the papermaking process.

EXAMPLES

Example 1

Preparation of Crude Lignin Dispersion

Lignin from hardwood birch was dispersed in aqueous alkali by solubilizing 10 g dry content of lignin-rich solids in 0.25 M NaOH (100 mL) under stirring/mixing for 30 min at 50° C. to obtain a lignin concentration of 100 g/L.

Residual solids were then separated from soluble fraction by centrifugation at 4000 rpm for 30 min and decanting after which the soluble fraction was collected. This soluble fraction is referred to herein as crude lignin dispersion. The pH of this dispersion was found to be 11.85. In this lignin dispersion, the lignin content was determined to be 90 g/L by UV-absorbance at 290 nm measured against standard curves ($Abs_{290\ nm}$ vs concentration) prepared from the corresponding lignin.

Example 2

Preparation of Lignin Dispersion Depleted of Small Lignin Molecules.

In this example it is described how to make a lignin dispersion depleted of lignin molecules below 2 kDa.

Lignin fractionation for preparation of a lignin dispersion depleted of small lignin molecules was performed in a vessel connected with cascading ultrafiltration (UF) unit operations. In a batch mode operation, the lignin in aqueous alkaline conditions (pH 10-12) is processed for a predetermined amount of time with a perfusion system using ultrafiltration membrane with a set of cascading molecular weight cut-offs (MWCO). Each UF membrane will subsequently retain lignin fractions with larger molecular weight (MW) and simultaneously separates out the smaller molecular weight lignin units. Thus, the retentate is the composition retained by the membrane obtained in the input vessel of the filtration system, whereas permeate is the composition containing the material that penetrated through the membrane and that is received in the vessel downstream of the membrane. Thus, the retentate contains the high molecular weight lignin, in other words the retentate contains lignin depleted of small lignin molecules. The molecular weight (MW) of retained lignin molecules depends on MWCO of the membrane. During the fractionation, the volume of the retentate is kept constant by water addition. Permeate of the first MWCO membrane was optionally further fractionated by subsequent UF and nanofiltration (NF) membrane operations with an ever decreasing MWCO selected. The temperature, pH, mixing speed, pressure and aeration in the vessel was controlled during the operation to control the fractionation yield. Each membrane operation was concluded with a concentration of the retentate. During the concentration water was no longer added to the retentate vessel, while filtration is continued. Thus the volume of the retentate was decreasing and the concentration of lignin was increasing. This was followed by diafiltration with at least five volumes of water. Retentate after diafiltration was collected. This retentate is referred here as lignin dispersion depleted of small lignin molecules.

The membrane set-up with following molecular weight cut-offs (MWCO) has been used: 100 kDa, 70 kDa, 50 kDa, 30 kDa, 10 kDa, 5 kDa, 3 kDa, 1 kDa, 0.2 kDa. MWCO refers to the lowest molecular weight solute (in daltons Da or kilodaltons kDa) in which 90% of the solute is retained by the membrane. Membrane specification MWCO does not necessarily corresponds to the respective molecular weight of the retained compounds due to differences in physical and colloidal properties of the compounds. For every chemical composition the actual cut-off molecular weight should be determined experimentally.

Example 3

Preparation of Lignin Emulsion

The lignin dispersions were stored at +4° C. in the dark. Prior to formulation, lignin dispersions were brought to room temperature overnight or placed in a warm (~40° C.) water bath for 1 h. This made lignin dispersions easier to handle during the process and prevented problems that are due to lignin solidification in refrigerator temperatures. The viscosity, pH and concentration of lignin dispersions were recorded before and after the preparation of the emulsion. In case the concentration exceeded 18% or if specific lignin fraction seemed more prone to solidification even in lower concentration, it was diluted with tap water to a desired level to achieve surface tension of 35-60 N/m. In case surface tension of the lignin dispersion was impacted due to low pH, 5M NaOH was used to increase the pH and bring the surface tension to the desired range.

The lignin concentration for the preparation of lignin emulsion was at least 50 g/L and preferably around 150 g/L. Stearic acid was added to the lignin solution at a 10% mass of the lignin dry mass. The amount of stearic acid was a result of comprehensive studies and had proven to be a reasonable yet effective amount together with lignin for improving moisture- and water-resistance and hydrophobicity of the paper.

Stearic acid was added into a glass bottle containing known weight of lignin dispersion and stirred gently. A hot water bath at 90° C. in the heat mixer was prepared for the incubation of the mixture at elevated temperature. Incubation time was 20 min for 100-200 mL sample and 30 min for samples above 250 mL to ensure proper melting and distribution of stearic acid. Gentle mixing and shaking of the bottle by hand every 8-10 minutes during incubation was found to be beneficial for a uniform dispersion of stearic acid. After the incubation, the mixture was poured into a blender. The blender was set to run at maximum speed for 5 minutes, or until the formulation was cooled down. The prepared formulation referred to as lignin emulsion was poured into a plastic sample bottle, let cool down in room temperature and used for spray coating or stored refrigerated.

Example 4

Preparing Paper Sheets and Spraying Lignin Emulsion in the Semi Wet Phase

A paper sheet was made from pulp suspension. The sheet was pressed mechanically to remove the excess water to reach about 40% dry sheet. The lignin emulsion was applied onto the sheet in the semi-wet phase by spraying. The emulsion was evenly distributed throughout the sheet area, allowing the emulsion to absorb into the sheets with an optimal dry deposit of about 5-15 g/m2.

The obtained sheet was fully dried in Rapid Köthen drier. The sheet was cured in an oven.

Aqueous penetration properties of the resulting sheets were tested by measuring short span compression strength using short span compression test (SCT 90%) and water resistance by Cobb60 test (see example 6).

For moisture resistance measurements, the cured sheet was conditioned for overnight in 50% or 90% relative humidity conditions. The term conditioned in this respect means placed in a chamber with controlled humidity level. The desired Cobb60 value was below 50 $g/m^2$.

Results of the SCT measurements of the sheets prepared according to this example with different amount of the deposit (between 5 and 15 g dry weight per m2) and conditioned at 50% humidity or 90% humidity are presented in FIG. 1. In this experiment, lignin emulsions prepared from hard wood lignin and soft wood lignin depleted of lignin molecules smaller than 6 kDa were used as indicated in the figure. Different furnishes: old corrugated container pulp (OCC), neutral sulphite semi chemical pulp (NSSC), unbleached softwood kraft pulp (UBSK), recovered Fiber pulp (RCF) were used. The numbers represent a % improvement of the SCT of the paper sheets prepared using the lignin emultions as compared to the control paper sample prepared without lignin emulsion. The improvement in SCT seen in low moisture (50%) is maintained when the furnishes are incubated at high moisture environment (90%).

Paper sheets prepared the same way but not conditioned in high humidity conditions were tested for water resistance using Cobb60 test. The results of these tests are presented in FIG. 7, numbers represent Cobb60 values. Cobb value of the control paper prepared without the lignin emultion was 250 g/m2.

In another experiment, lignin dispersion was fractionated using membranes with different MWCO (see example 2).

Cut off molecular weights for the resulting lignin dispersions were determined using high performance liquid chromatography (HPLC). Lignin dispersion depleted of molecules below 1.1 kDa, 2.3 kDa, 3.9 kDa, 4.9 kDa, 7.9 kDa and 10 kDa were obtained and the corresponding lignin emulsions and paper sheets were prepared according to the examples 3 and 4.

Figure 2:
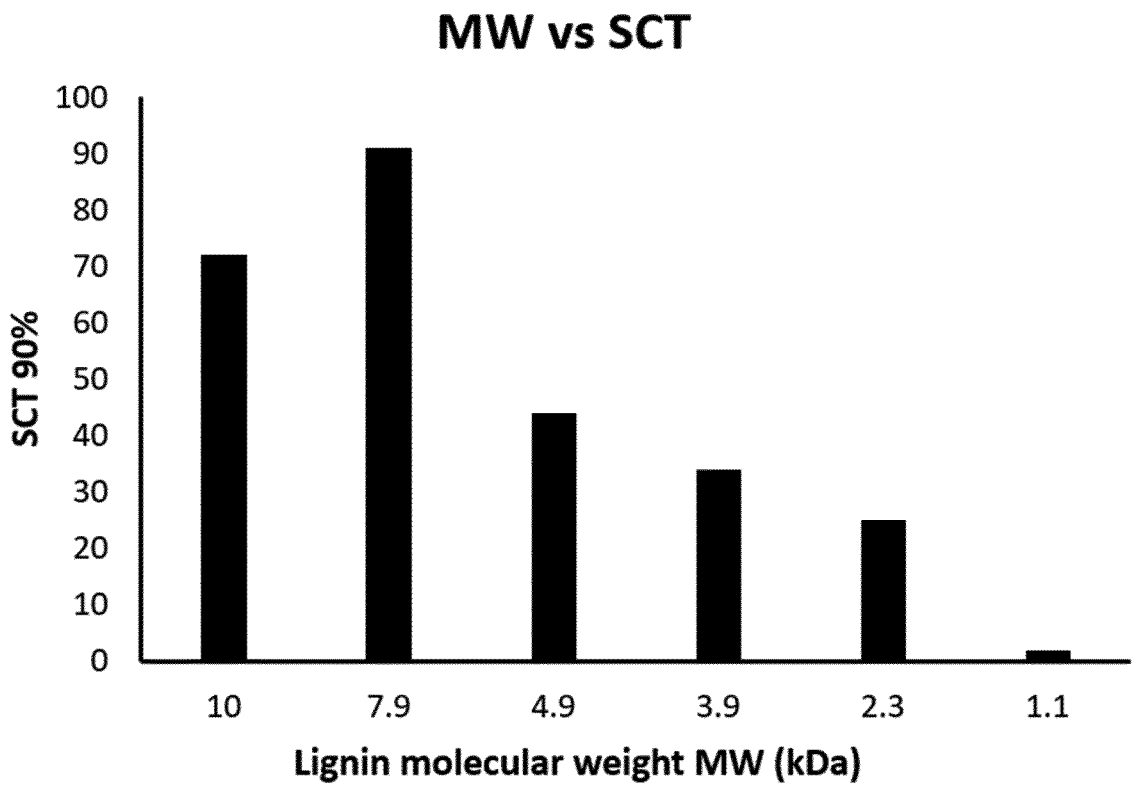
FIG. 2 depicts the percentage improvement of Short span compression test (SCT 90%) of paper prepared using different lignin size fractions in the additive. Different lignin fractions depleted of molecules with molecular weight below 1.1 kDa, 2.3 kDa, 3.9 kDa, 4.9 kDa, 7.9 kDa and 10 kDa were used. Zero (0) represents a control sample without the lignin additive.

Results of short span compression test (SCT 90%) of the paper prepared with these lignin emulsions are presented in FIG. 2. The bars represent a % improvement of the SCT at 90% humidity as compared to the control paper sample prepared without lignin emulsion.

Figure 5:
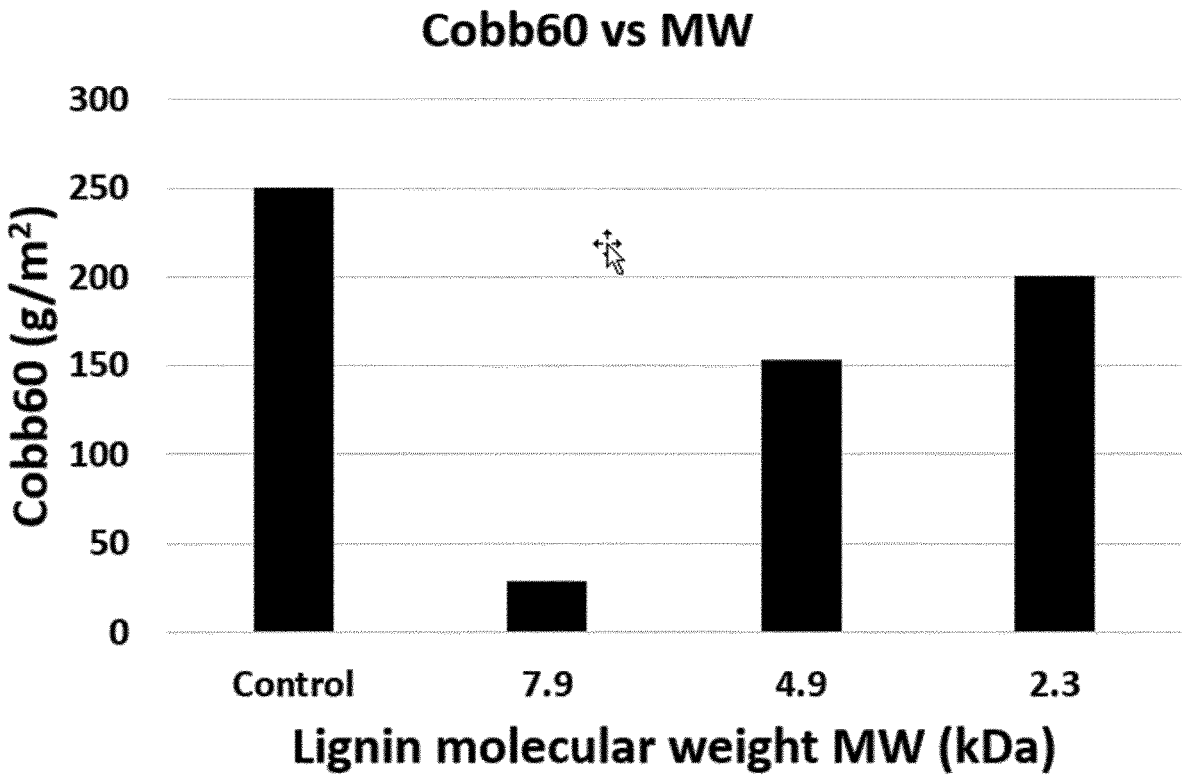
FIG. 5 depicts Cobb60 values for water uptake. Lignin depleted of molecules with a molecular weight below 2.3 kDa, 4.9 kDa and 7.9 kDa were used. It was observed that the Cobb60 value depends on the molecular weight (MW) of lignin. The presence of small lignin fractions i.e. low MW lignin results in higher Cobb60 value. The control refers to the OCC pulp sheets without the additive.
Figure 6A:
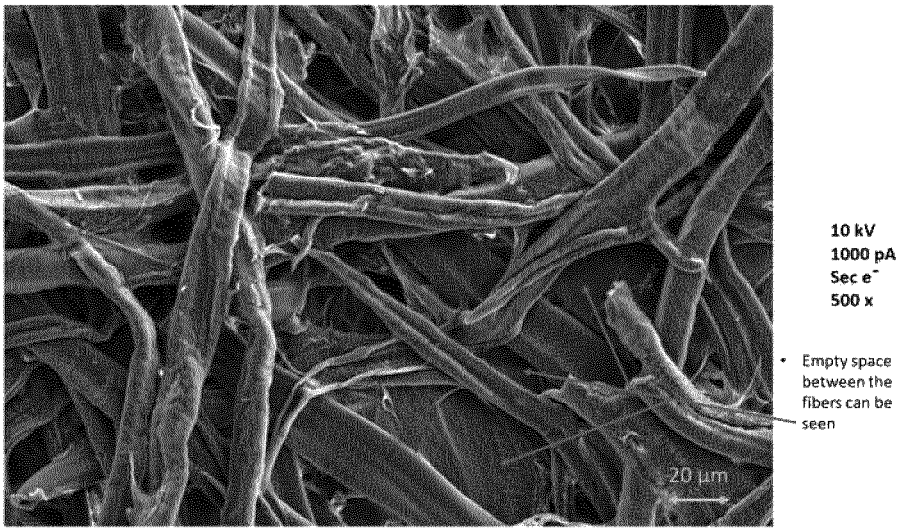
FIGS. 6A, 6B, 6C and 6D present laboratory sheets which were analyzed using scanning electron microscopy (SEM). SEM images of cross sections of Smurfitt-kappa OCC laboratory handsheets semi-wet coated with lignin emulsion as described herein are presented. The SEM images provide information how the additive has penetrated the interwoven fiber networks in bringing strength properties to the OCC sheet. kV value refers to energy of the applied electron beam. pA value refers to a probe current.
Figure 6B:
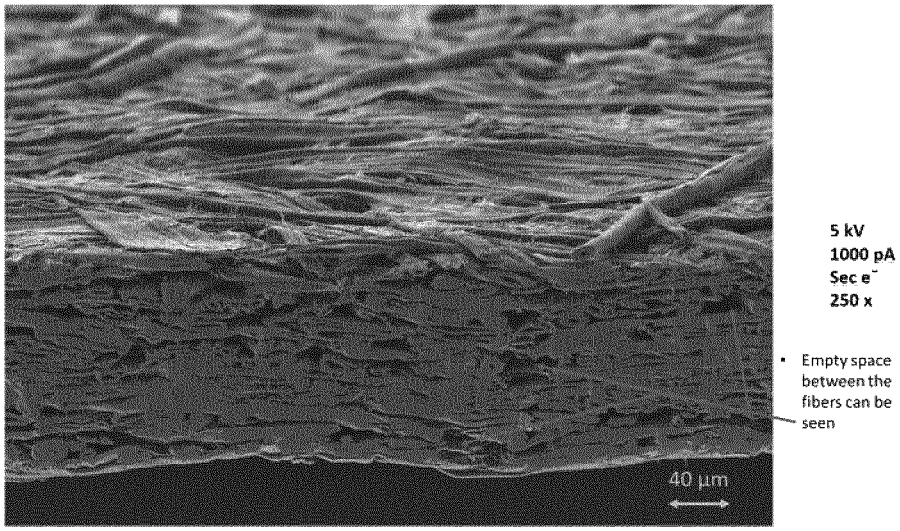
Figure 6C:
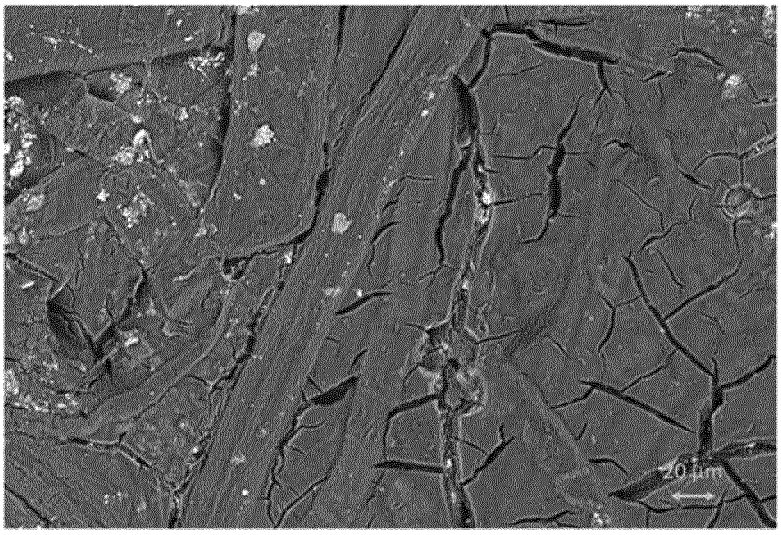
Figure 6D:
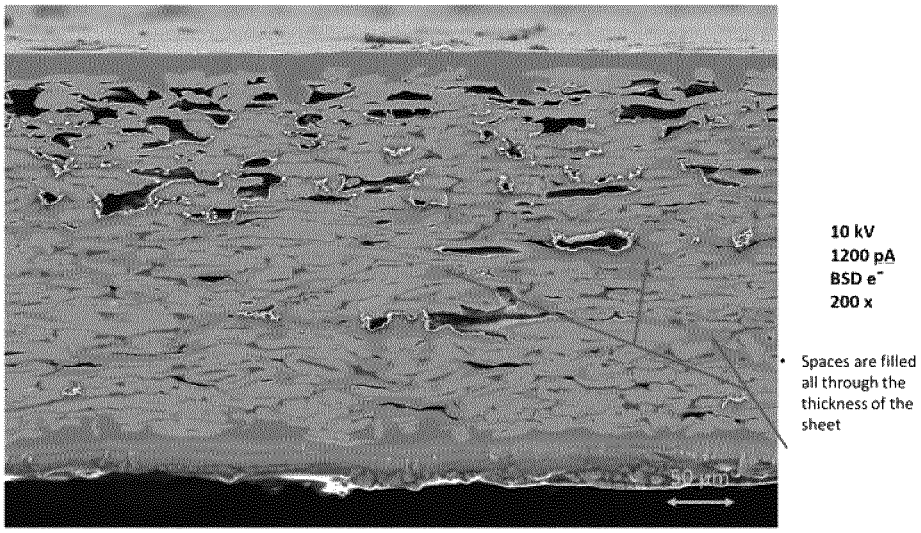
Figure 8:
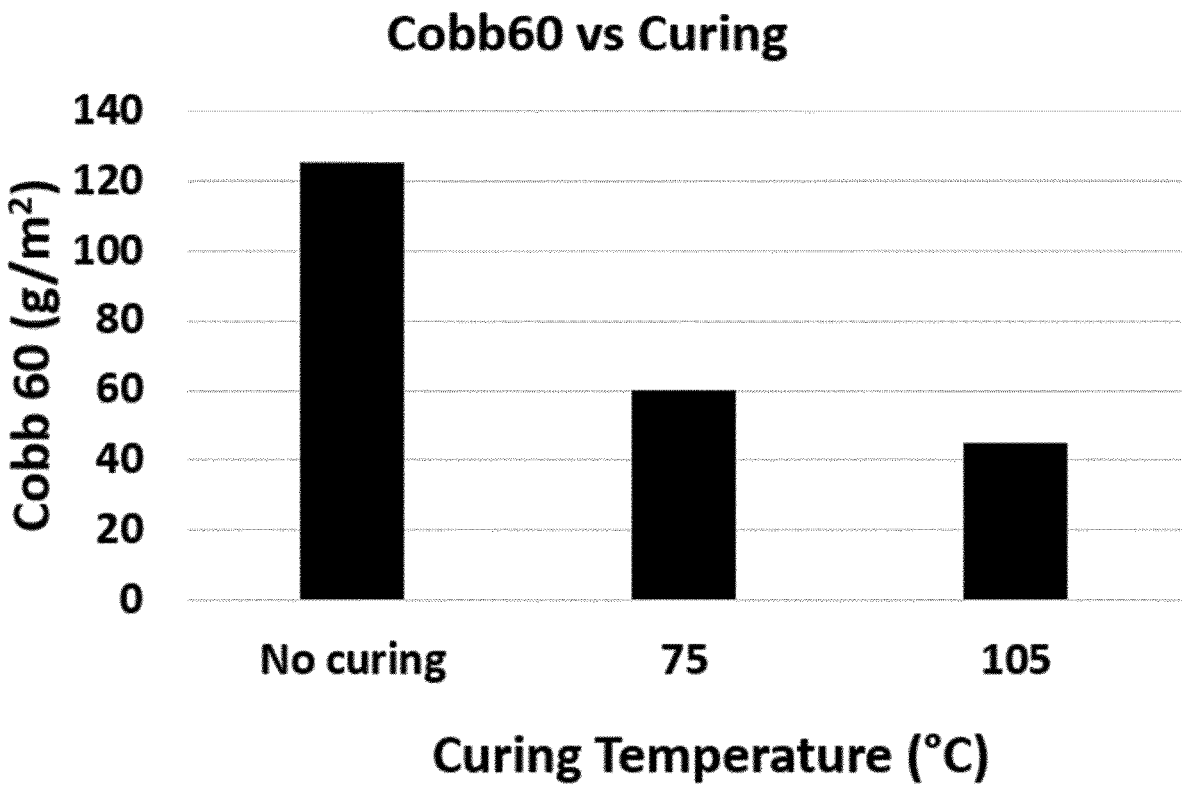
FIG. 8 depicts impact of curing on Cobb60 (g/m$^2$) value. Normal curing was carried out at 105° C. for 1 hour.
Figure 9A:
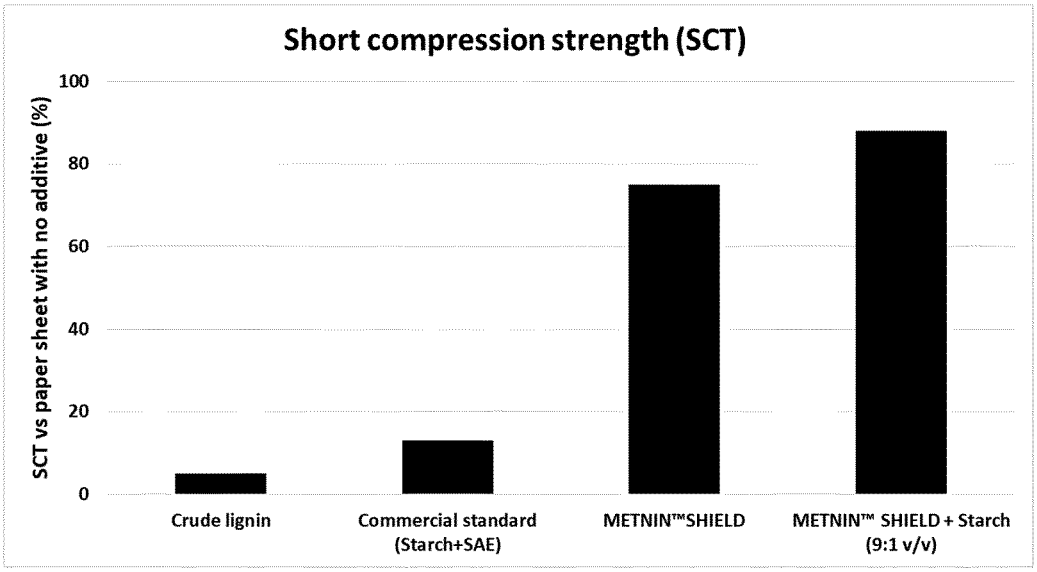
FIG. 9A: Short compression strength (SCT) improvement values for paper sheets conditioned at 23° C./90% RH for 24 h. The expression "METNIN™ SHIELD" represents emulsions made from fractionated lignin. Control sample without additive=0.
Figure 9B:
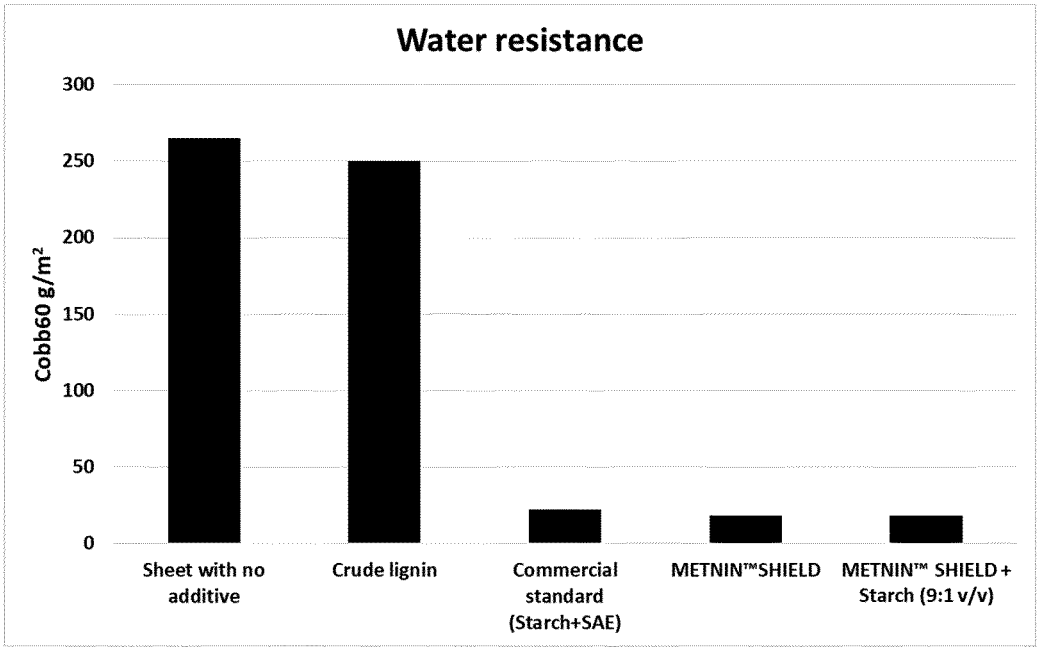
FIG. 9B: Water resistance values (Cobb60) for paper sheets. The expression "METNIN™ SHIELD" represents emulsions made from fractionated lignin.
Figure 9C:
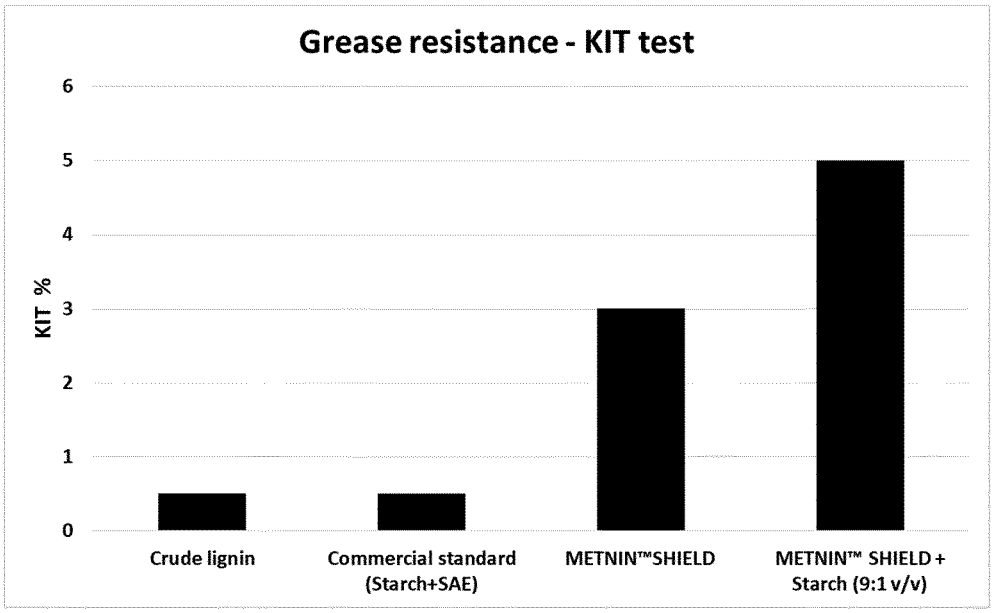
FIG. 9C: Grease resistance values (KIT) for paper sheets. The expression "METNIN™ SHIELD" represents emulsions made from fractionated lignin.
Figure 9D:
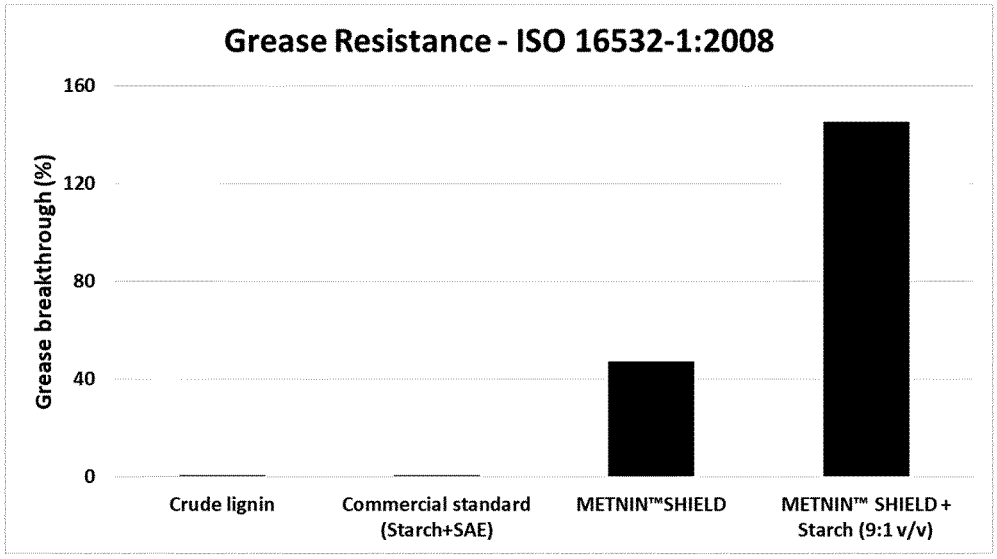
FIG. 9D: Grease resistance values for paper sheets according to ISO 16532-1:2008. The sheets are conditioned in 23° C./50% RH for 24 h before testing. The expression "METNIN™ SHIELD" represents emulsions made from fractionated lignin.

Paper sheets prepared the same way but not conditioned in high humidity conditions were tested for water resistance using Cob60 test. The results of these tests are presented in FIG. 5, numbers represent Cobb60 values. The lower Cobb60 value represent more water resistant paper.

Cobb test is used to determine water resistance or hydrophobicity of the paper or other packaging materials (see Example 6). As opposed to moisture resistance when the sample is conditioned in a high-moisture environment, in case of water resistance the sample is brought to the direct contact with water and the amount of water absorbed by the sample is measured in g/m2 (grams of water per square meter of sample surface). For packaging paper Cobb60 test is most suitable, measuring the mass of water that gets absorbed into a square meter of paper during 60 s under the conditions of the test. The more water is absorbed—the higher Cobb60 value is and the lower water resistance or hydrophobicity of the paper is. Thus, it is desirable for the packaging materials such as boxes and envelopes that Cobb values are low, preferably below 50 g/m2.

In yet another experiment, lignin emulsions were prepared from soft wood lignin obtained from craft pulping process. With reference to FIG. 9, the following three lignin emulsions were prepared: "crude lignin" emulsion was made from non-fractionated lignin; "METNIN SHIELD" emulsion was prepared from lignin dispersion depleted from molecules smaller than 8 kDa and "METNIN SHIELD+starch" emulsion was prepared from METNIN SHIELD emulsion by adding 18% starch solution in water in ration 9:1 v/v (nine parts of METNIN SHIELD and one part starch solution). A control additive "starch+SAE" was prepared to represent industry standard sizing solution. "Starch+SAE" additive comprised 150 g/L starch solution in water containing 25 g/L SAE sizing agent. Paper sheets (100 g/m2) were prepared from OCC pulp with respective lignin emulsions, industry standard additive, and without any additives. The lignin emulsions were deposited at 6 g/m2 dry weight and the "Starch+SAE" additive was deposited at 3 g/m2. For the starch-rich additives such as "Starch+SAE" additive, 3 g/L is a standard deposit density, as this additive does not penetrate deep in the fiber web and large quantity of the additive is not absorbed by the paper.

Four paper sheets prepared with each additive were tested for aqueous penetration properties and for grease resistance using KIT test and ISO 16532-1:2008 grease resistance test (see example 8). The results are presented in FIGS. 9 *a, b, c* and *d*. As seen from the diagrams, lignin emulsions containing lignin depleted of low molecular weight molecules ("METNIN SHIELD" and "METNIN SHIELD+starch") infer a much better protection from aqueous penetration, such as higher moisture resistance of the paper as seen from higher SCT strength numbers (FIG. 9*a*) and lower water absorption as seen from lower Cobb60 values. It is also evident from this experiment that lignin emulsions containing lignin depleted of low molecular weight molecules ("METNIN SHIELD" and "METNIN SHIELD+starch") infer a much higher grease resistance as seen from higher KIT values and grease breakthrough values determined by ISO 16532-1:2008 test. Addition of starch to the lignin emulsion further improves grease resistance.

Example 5

Preparing Paper Sheets and Adding an Additive after a Press Section

Sheets leaving the sheet press for spraying should have semi-wet moisture content in the range 20 to 90% preferably 40%. The lignin dispersion/emulsion was sprayed uniformly onto the semi-wet paper sheets after the press section. The covered area in the surface of sample sheets should be as evenly distributed as possible, allowing the additive to absorb into the sheets with an optimal dry deposit of about 5-15 g.

Different furnishes: old corrugated container pulp (OCC), neutral sulphite semi chemical pulp (NSSC), unbleached softwood kraft pulp (UBSK), recovered Fiber pulp (RCF) were used.

Example 6

Testing Aqueous Penetration Properties of Paper by Measuring the Short-Span Compression Strength (SCT) and Water Absorption (Cobb60) of Paper.

Cobb60

The objective of Cobb test is to measure water absorptiveness of a paper sample on a specific area within a set time (TAPPI T 441 om-09). The measurement can be conducted without further incubation in standard conditions. From each coated handsheet and reference sheet two Cobb circles with diameter of 85 mm are cut by a circle sample cutter. Beside Cobb test device, a precision balance with accuracy of 0.001 g, a 50 ml measuring glass and a couching roll are required. Area of 100 $cm^2$ is standard for Cobb test but there are devices with different areas available. The specimen is first weighed dry and positioned on the rubber plate of the Cobb test device. Cobb test cylinder is placed on top of the specimen and clamped in the middle of it. The clamping crossbar is tightened firmly on both ends to prevent water leakage during the test. 40 mL of water is quickly poured inside the Cobb test cylinder creating a 1 cm water column on the sample surface. A timer is started as soon as water touches the surface. Cobb60 is most suitable for lignin dispersion/emulsion coated hand sheet samples and is measured as the mass of water that gets absorbed into a square meter of paper during 60 s, but other times like Cobb120 or Cobb300 can be performed additionally as well. After set time, water is poured out from the Cobb test device and metal crossbar is released. Specimen is carefully placed on one sheet of tissue handpaper and two more sheets are placed on top of it. It is rolled over back and forth with a couch roll to remove excessive amount of water on the surface, moved to a dry location between handpapers and rolled once again the same way. Finally, specimen can be weighed again to determine the amount of water absorbed into the paper. Cobb value is calculated as:

$$\text{Weight of water}\left(g/m^2\right) = [\text{Final weight} - \text{Dry weight}] \times 250$$

This coefficient number 250 comes from equation 1/[Area in $m^2$]=1/0.0040 and is derived from the surface area of 40 $cm^2$ to convert the value to cover 1 $m^2$. It can be altered for different test areas, for example coefficient 100 for area test of 100 $cm^2$. If there is any leaching effect noticed after Cobb test (i.e. change in color of water leaving the Cobb device or on the handpaper after couch rolling) operator should take note.

Short-Span Compression Test (SCT)

Short span Compression Test (SCT) is conducted to determine the edgewise compression strength of laboratory sheets as it can be used to predict the performance of container board used in the manufacture of corrugated boxes. When testing the lignin dispersion/emulsion coated sheet properties, four strips that are exactly 15 mm wide and at least 8 cm long are cut from each of the coated handsheets coated. The grammages of the samples were measured and recorded before cutting. Two of the strips are placed in a humidity chamber that is set to 23±0.5° C. and 50±2% RH, and let condition for a minimum of 4 hours, preferably overnight. The other two strips are placed in a humidity chamber that is set to 23±0.5° C. and 80±2% RH and let condition similarly for a minimum of 4 hours, preferably overnight.

0.7 mm span is used for paper and board samples over 80 $g/m^2$. Tests of lower grammage samples (i.e. less than 80 $g/m^2$) should be conducted with 0.3 mm span, or else the samples will bend before compressing. Although thickness does not play any role in the result calculation, span to thickness ratio should be less than 5. Before each measurement grammage of the individual sample is fed to the instrument to record indexed strength values and thus to be able to compare samples of different grammages. Specimen is taken from the chamber and placed between the clamps of PTA Short span Compression Tester, after which the test is immediately launched. Clamps move slowly towards each other while compressing the specimen, and the maximum load is recorded before a compressive failure occurs. A second test is conducted at another measuring point of the specimen instantly after the first one to avoid drying. This is repeated with another strip, after which a summary of four measurements is shown on the instrument screen and can be recorded.

Example 7

Printability Test

Printability testing of liner papers with additives was performed using flexo printing technology. All tests were carried out on IGT F1 laboratory flexo tester with Kodak 2.4 mm photopolymer plates and Doneck/Sun Chemical water-based inks which are used in corrugated board printing. Mottling is an important optical parameter regarding optical covering of the surface where print unevenness can cause problems in colour reproduction. Mottling and the wicking test is analyzed through printing and image analysis. Ink abrasion testing is important in handling of the boxes, packaging or bags as ink abrasion can damage the printed elements. The ink abrasion is done with the Prufbau quadrant system with 50 $g/cm^2$ weights, which is an industrial standard for such testing.

For flexo printing, IGT F1 flexo printability tester with the following setup Anilox Force 90N, Printing Force 125N, Speed 60 m/s and with Anilox roller with 80 L/cm, 45° angle and with ink transfer of 8.5 $mL/m^2$ was used. The photopolymer plates were 1.7 mm thick and imaged with HD Flexo technology and a commercially available Doneck water based ink which had adjusted ink viscosity of 18s (measured with ISO 4 ink up). The mottling tendency (ink coverage), ink density and made USB microscope images of the printed parts were measured. The liner papers with additives showed good flexo printability with water based inks.

Example 8

Measuring grease resistance of paper sheets by KIT test and ISO 16532-1:2008. KIT method follows the TAPPI UM 557 "Repellency of Paper and Board to Grease, Oil, and Waxes (Kit Test)." Each test unit of the sample was cut into five test specimens at least 51 mm×152 mm (2 in.×6 in.). If both sides are to be tested, these sheets can be cut in half in the long direction to make a set of paired (felt side/wire side) specimens. Label or identify in some manner each side of the test specimens. Since paper and paperboard may be treated on one side or both sides, or the treatment may be different between sides, depending on the end use, the tester must decide which side(s) to test.

ISO 16532-1:2008 specifies a method for the determination of the grease resistance of paper and board. The paper or board can be tested creased or uncreased. The test is primarily intended to establish a level of grease resistance by determining the time taken for a simulated "fat material" (palm kernel oil) to penetrate (break-through) the sheet for papers such as food board, and greaseproof and vegetable parchment. It is also applicable to paper and board which have been internally or surface sized with organophobic materials, or made grease resistant by a plastic extrusion coating.

The invention claimed is:

1. A method for manufacture of a paper sheet with an increased resistance to aqueous penetration comprising:

a. providing a lignin emulsion with a surface tension of 35-60 N/m comprising a mixture of:

i. a lignin dispersion in an aqueous medium at a concentration of at least 50 g/l of dry solid content and ii. at least one fatty acid, wherein the lignin dispersion has an alkaline pH, and wherein the lignin is depleted of molecules with a molecular weight below 2 kDa by selectively removing molecules below 2 kDa by ultrafiltration with a filter with a molecular cut-off of 2 kDa or more; and b. adding said emulsion to a fibrous web during a semi-wet phase of a papermaking process;

thereby obtaining a paper sheet with an increased resistance to aqueous penetration in comparison to a paper sheet manufactured by an otherwise identical process without the lignin emulsion.

2. The method according to claim 1, wherein the surface tension of the lignin emulsion is 45-60 N/m.

3. Method according to claim 1, wherein the pH of the emulsion is 9-11.

4. The method according to claim 1, wherein the fatty acid is selected from the group consisting of palmitic acid, stearic acid, gallates and abietic acid, and a mixture thereof.

5. A composition for use in a paper making process, the composition obtained by the method according to claim 1 and comprising a lignin emulsion with a surface tension of 35-60 N/m wherein the lignin emulsion comprises a mixture of a lignin dispersion in an aqueous medium at a concentration of at least 50 g/l of dry solid content at an alkaline pH and at least one fatty acid, and wherein the lignin is depleted of molecules with a molecular weight below 2 kDa.

6. The composition according to claim 5, wherein the surface tension of the lignin emulsion is 50-60 N/m.

7. The composition according to claim 5, wherein the pH of the emulsion is 9-10.

8. The composition according to claim 5, wherein the surface tension of the lignin emulsion is 45-60 N/m.

9. The composition according to claim 5, wherein the pH of the emulsion is 9-11.

10. The composition according to claim 5, wherein the fatty acid is selected from the group consisting of palmitic acid, stearic acid, gallates and abietic acid, and a mixture thereof.

11. A method for preparation of a lignin emulsion with a surface tension of 35-60 N/m wherein a lignin dispersion in an aqueous medium at a concentration of at least 50 g/l of dry solid content is mixed with at least one fatty acid, wherein the lignin dispersion has a pH of 9-11, and wherein the lignin is depleted of molecules with a molecular weight below 2 kDa.

12. The method according to claim 11, wherein the fatty acid is selected from the group consisting of palmitic acid, stearic acid, gallates and abietic acid, and a mixture thereof.

13. The method according to claim 1, wherein the lignin is depleted of molecules with a molecular weight below 3 kDa.

14. A paper sheet obtained by the method according to claim 1.

15. The method according to claim 1, wherein the lignin dispersion in an aqueous medium is at a concentration of at least 100 g/l of dry solid content.

16. The method according to claim 1, wherein the surface tension of the lignin emulsion is 50-60 N/m.

17. The method according to claim 1, wherein the pH of the emulsion is 9-10.

18. The method of claim 1, wherein the ultrafiltration uses a molecular cut-off filter of 1,500 Da or smaller.

* * * * *